US009834415B2

(12) United States Patent
Hense et al.

(10) Patent No.: US 9,834,415 B2
(45) Date of Patent: Dec. 5, 2017

(54) ELEVATOR SYSTEM FOR A BUILDING UNDER CONSTRUCTION

(71) Applicant: THYSSENKRUPP ELEVATOR AG, Essen (DE)

(72) Inventors: Marc Hense, Neuhausen (DE); Jürgen Becker, Wendlingen (DE); Jörg Müller, Deizisau (DE); Karl-Otto Schöllkopf, Esslingen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 145 days.

(21) Appl. No.: 14/648,194

(22) PCT Filed: Nov. 25, 2013

(86) PCT No.: PCT/EP2013/074639
§ 371 (c)(1),
(2) Date: May 28, 2015

(87) PCT Pub. No.: WO2014/082971
PCT Pub. Date: Jun. 5, 2014

(65) Prior Publication Data

US 2015/0298940 A1 Oct. 22, 2015

(30) Foreign Application Priority Data

Nov. 29, 2012 (DE) ..... 10 2012 111 622

(51) Int. Cl.
*B66B 19/00* (2006.01)
*B66B 5/04* (2006.01)

(52) U.S. Cl.
CPC ..... *B66B 19/00* (2013.01); *B66B 5/04* (2013.01); *B66B 5/042* (2013.01)

(58) Field of Classification Search
CPC ..... B66B 19/00; B66B 5/04; B66B 5/042
(Continued)

(56) References Cited

U.S. PATENT DOCUMENTS 1,738,215 A * 12/1929 Thurston ..... B66B 5/04 187/266
2,707,531 A * 5/1955 Di Bartolomeo ..... B66B 5/04 187/370

(Continued)

FOREIGN PATENT DOCUMENTS

DE 60003910 T 5/2004
DE 202005016080 U 12/2005

(Continued)

OTHER PUBLICATIONS

German language International Search Report for International patent application No. PCT/EP2013/074639; dated Mar. 12, 2014.

(Continued)

*Primary Examiner* — Michael Riegelman
(74) *Attorney, Agent, or Firm* — thyssenkrupp North America, Inc.

(57) ABSTRACT

The invention relates to an elevator system (10) for a building under construction, comprising a vertical shaft (12), in which a temporary machine compartment (14) is retained, a driving device (18), which is arranged in the temporary machine compartment (14) and which is coupled by means of a supporting cable (21) to a car (23) that can be moved vertically up and down in the shaft (12), and a speed limiter (30), which interacts with a speed limiter cable (34) arranged in the shaft (12). According to the invention, in order to develop the elevator system in such a way that the speed limiter cable (34) can be extended in a simple manner when the temporary machine compartment (14) is moved without said action leading to permanently increased energy consumption of the elevator system (10), the speed limiter (30) is arranged on the car (23) or on a counterweight (25) connected to the car (23) by means of the supporting cable (21), and that the speed limiter cable (34) has a first and second cable section (32, 52), wherein the first cable section (Continued)

(32) is clamped in a stationary manner between a cable retainer (46) connected to the temporary machine compartment (14) in a stationary manner and a releasable clamping device (50) arranged in a lower shaft region (48) and the second cable section (52) is connected to the first cable section (32) in the lower shaft region (48) and is stored in a storage region.

19 Claims, 3 Drawing Sheets

(58) Field of Classification Search
USPC ..... 187/414
See application file for complete search history.

(56) References Cited

U.S. PATENT DOCUMENTS

| | | | | |
|---|---|---|---|---|
| 3,519,101 | A * | 7/1970 | Sieffert | B66B 9/187 187/256 |
| 5,000,292 | A * | 3/1991 | Chapelain | B66B 19/002 187/408 |
| 5,033,586 | A * | 7/1991 | Richards | B66B 9/187 187/259 |
| 6,202,795 | B1 | 3/2001 | Bluteau | |
| 8,602,175 | B2 * | 12/2013 | Korkeakangas | B66B 19/02 187/414 |
| 9,561,935 | B2 * | 2/2017 | Perala | B66B 11/0005 |
| 2009/0223751 | A1 * | 9/2009 | Peacock | B66B 19/00 187/414 |
| 2009/0260926 | A1 * | 10/2009 | Van Der Meijden | B66B 19/02 187/350 |
| 2010/0163347 | A1 * | 7/2010 | Van Der Meijden | B66B 19/00 187/254 |
| 2012/0124807 | A1 * | 5/2012 | Mertala | B66B 19/02 29/428 |
| 2012/0291395 | A1 * | 11/2012 | Plathin | B66B 19/02 52/741.1 |
| 2015/0034425 | A1 * | 2/2015 | Ratia | B66B 7/06 187/249 |
| 2016/0200550 | A1 * | 7/2016 | Reuter | B66B 19/00 187/254 |

FOREIGN PATENT DOCUMENTS

| | | | |
|---|---|---|---|
| DE | 102009019079 | A | 11/2010 |
| EP | 2243739 | A2 | 10/2010 |
| JP | S51 129055 | A | 11/1976 |
| JP | H04 7285 | A | 1/1992 |
| WO | 2008/077992 | A1 | 7/2008 |

OTHER PUBLICATIONS

English translation of International Search Report for International patent application No. PCT/EP2013/074639; dated Mar. 12, 2014.
English translation of abstract of JP S51 129055 (A).
English translation of abstract of EP 2243739 (A2).
English translation of abstract of JP H04 7285 (A).
English abstract for DE202005016080U.
English abstract for DE102009019079A.

* cited by examiner 28
34
32
60
61
62
68
58
50
64
66
70
52

ELEVATOR SYSTEM FOR A BUILDING UNDER CONSTRUCTION

CROSS REFERENCE TO RELATED APPLICATIONS

This application is a U.S. National Stage Entry of International Patent Application Serial Number PCT/EP2013/074639, filed Nov. 25, 2013, which claims priority to German Patent Application No. DE 102012111622.9 filed Nov. 29, 2012, the entire contents of both of which are incorporated herein by reference.

FIELD

The present disclosure generally relates to elevator systems, including elevator systems for buildings under construction.

BACKGROUND

Elevator systems usually have a drive device which is coupled via a supporting cable to a car that can be made to move upward and downward in the vertical shaft. Frequently, the car is also connected via the supporting cable to a counterweight. The car is often driven by means of a driving disk over which the supporting cable is guided. In order to be able to limit the speed of the car in the event of a fault, use is made, in addition to a break acting on the drive of the car, of a separate speed limiter which cooperates with a speed limiter cable arranged in the shaft. The speed limiter is coupled to a gripping device which is arranged on the car. Together with the gripping device, the speed limiter ensures that, independently of the drive and also independently of the brake of the elevator system, the travel of the car is stopped as soon as a predefined speed is exceeded. Accordingly, a speed limiter can also be used to limit the speed of the counterweight connected to the car.

In high-rise buildings, such elevator systems are already required when constructing the building, in order to bring construction workers and material as close as possible to that storey on which the construction work is currently being carried out. To that end, elevator systems are known which are initially installed in a first, already-completed shaft region, such that this shaft region can be served by the elevator system. As construction progresses, the elevator system is moved stepwise upward in the shaft so as to increase that portion of the shaft that can be served by the elevator system. Moving the elevator system into a higher shaft region makes it necessary, inter alia, to also lengthen the speed limiter cable. To that end, it can be provided that the initially-used speed limiter cable is replaced with a longer speed limiter cable. However, this involves considerable cost.

WO 2008/077992 A1 proposes guiding a speed limiter cable around a lower deflection pulley arranged in the pit and around an upper deflection pulley arranged in the temporary machine compartment, and to secure a first end of this cable in a positionally-fixed manner on the car. The second end of the speed limiter cable is wound onto a cable roll which is arranged on the roof of the car. When the temporary machine compartment is moved into a higher shaft region, the effective length of the speed limiter cable can be increased in that a cable section which is required for the lengthening is unwound from the cable roll. A disadvantage of such a configuration is that the weight of the car is increased by the cable roll arranged on the roof of the car and that portion of the speed limiter cable which is wound thereon. This leads to a long-term increase in the energy consumption of the elevator system. Furthermore, in the case of such a configuration, the weight of the car changes when the temporary machine compartment is moved. This in turn makes it necessary to change the counterweight and influences the traction calculations.

SUMMARY

The invention has the object of developing an elevator system of the type mentioned in the introduction such that, when the temporary machine compartment is moved, the speed limiter cable can be lengthened in a simple manner without this leading to a long-term increase in the energy consumption of the elevator system.

In the case of a generic elevator system, this object is achieved according to the invention in that the speed limiter is arranged on the car or on a counterweight connected to the car via the supporting cable, and in that the speed limiter cable has a first and a second cable section, wherein the first cable section is clamped in a positionally-fixed manner between a cable retainer that is connected in a positionally-fixed manner to the temporary machine compartment and a releasable clamping device arranged in a lower shaft region, and wherein the second cable section connects in the lower shaft region to the first cable section and is stored in a storage region.

In the case of the elevator system according to the invention, the speed limiter is arranged on the car or on the counterweight connected to the car via the supporting cable. The speed limiter cooperates with a first cable section of the speed limiter cable which is clamped in the shaft between a cable retainer that is connected in a positionally-fixed manner to the temporary machine compartment and a releasable clamping device arranged in a lower shaft region.

In the case of the elevator system according to the invention, in order to be able to move the temporary machine compartment upward in the shaft, a second cable section which is stored in a storage region adjoins the first cable section of the speed limiter cable which is clamped in the shaft. The second cable section thus forms a cable store for the effective length of the speed limiter cable. If the temporary machine compartment is to be moved upward in the shaft, the speed limiter cable can simply be lengthened in that the clamping device arranged in the lower shaft region is released and a desired lengthening section is removed from the cable store. Once the temporary machine compartment has reached its intended position in the shaft, the clamping device in the lower shaft region can be tightened once again, such that henceforth a lengthened first cable section is clamped between the cable retainer arranged in the temporary machine compartment and the clamping device arranged in the lower shaft region.

Since, in the case of the elevator system according to the invention, the cable store for the speed limiter cable is arranged in a storage region outside the car and the counterweight, the weight of the car and/or of the counterweight is not increased by the cable store of the speed limiter cable, such that the energy consumption of the elevator system for moving the car vertically upward and downward in the shaft can be relatively low.

The storage region is preferably arranged in the shaft, in particular in the lower shaft region or outside the shaft, for example in an adjacent space.

It is expedient if an end region of the second cable section is wound onto a cable drum in the storage region.

The cable drum can for example be rotatably mounted in a pit.

It can in particular be provided that the cable drum is positioned on the floor of the shaft.

In one advantageous embodiment, the releasable clamping device has a releasable cable clamp. In such a configuration, the first cable section is clamped between the cable retainer arranged in the temporary machine compartment and the releasable cable clamp. The cable clamp can for example have two clamping jaws which can be moved back and forth between a clamping position and a release position. In the clamping position, the speed limiter cable can be clamped between the two clamping jaws, and in the release position a desired lengthening section of the speed limiter cable can be fed between the two clamping jaws in order to lengthen the first cable section when moving the temporary machine compartment.

It is advantageous if the cable clamp cooperates with a clamping weight that can be made to move in the vertical direction. The clamping weight can apply a clamping force on the cable clamp.

Preferably, the clamping weight has a carriage which is held on a guiding device such that it can be displaced in the vertical direction, on which at least one weight element is held, and which is connected to the releasable cable clamp.

Expediently, the at least one weight element is releasably held on the carriage. To that end, the carriage can form a recess into which the at least one weight element can be inserted—preferably without the use of tools. This makes it possible to simply change the clamping force acting on the first cable section of the speed limiter cable, in that the weight element is exchanged or, in addition, at least one further weight element is inserted into the recess.

The guiding device of the carriage has, in an advantageous embodiment, two guiding rails, on which the carriage is held displaceably. Expediently, the carriage is positioned between the two guide rails.

Also the car and preferably also the counterweight used in an advantageous embodiment are expediently guided on guiding rails.

BRIEF DESCRIPTION OF THE FIGURES

The following description of an advantageous embodiment of the invention serves, in conjunction with the drawing, for a more detailed description. In the figures.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to an elevator system for a building under construction. In some examples, such an elevator system may include having a vertical shaft within which is held a temporary machine compartment, a drive device that is disposed in the temporary machine compartment and is coupled via a supporting cable to a car that can be made to move upward and downward in the shaft, and a speed limiter for limiting the speed of the car. The speed limiter may cooperate with a speed limiter cable disposed in the shaft.

Figure 1:
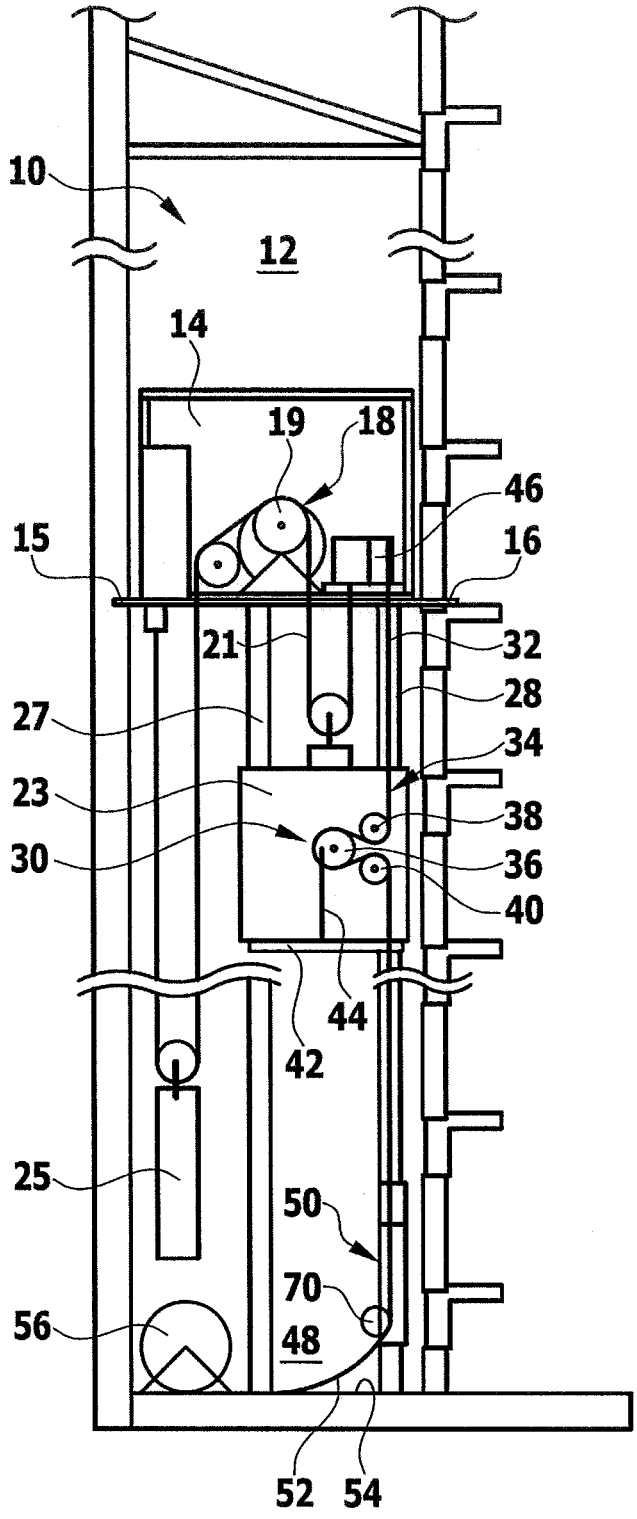
FIG. 1 is a schematic representation of an advantageous embodiment of an elevator system according to the invention, which is installed in the shaft of a building under construction.

FIG. 1 shows, schematically, a preferred embodiment of an elevator system 10 according to the invention, which is installed in a vertical shaft 12 of a building under construction. The elevator system 10 comprises a temporary machine compartment 14 which is releasably secured in the shaft with the aid of attachment members 15, 16. A drive device 18 for the elevator system 10, with a driving disk 19, which is driven by a motor and can be braked by means of a brake that is known per se (and is not shown in the drawing for the purpose of improved clarity), is positioned in the machine compartment 14.

The drive device 18 is coupled to a car 23 and to a counterweight 25 via a supporting cable 21. The car is held in a vertically displaceable manner on first guiding rails 27, 28 which are secured in the shaft 12. Guiding rails (not shown in the drawing for the purpose of improved clarity) are also used for guiding the counterweight 25.

The car 23 can be moved vertically upward and downward along the first guiding rails 27, 28 by means of the drive device 18 and the driving disk 19.

In order to be able to limit the speed of the car 23 in the event of a fault, a speed limiter 30 is arranged on the car 23, which speed limiter cooperates with a first cable section 32 of a speed limiter cable 34. As explained above, in other examples such as that shown in FIG. 3, the speed limiter 30 may be disposed on the counterweight 25. The speed limiter 30 has, as is conventional, a cable roll 36 around which the first cable section 32 is guided in an Ω shape. Two deflection pulleys 38, 40 are used to feed the first cable section 32 to the cable roll 36. On the cable roll 36 there are arranged centrifugal bodies which are known per se to a person skilled in the art and are therefore not shown in the drawing for the purpose of improved clarity, and which, if the speed of the car 23 exceeds a predetermined value, connect the cable roll 36 via a linkage 44 to a gripping device 42 arranged on the car 23, which gripping device is then triggered by the cable roll 36. The gripping device 42 cooperates, via brake elements which are known per se to a person skilled in the art and are therefore not shown in the drawing for the purpose of improved clarity, with the first guiding rails 27, 28, such that, if the speed of the car 23 exceeds a predetermined value, the car 23 is braked by means of the brake elements of the gripping device 42.

Figure 3:
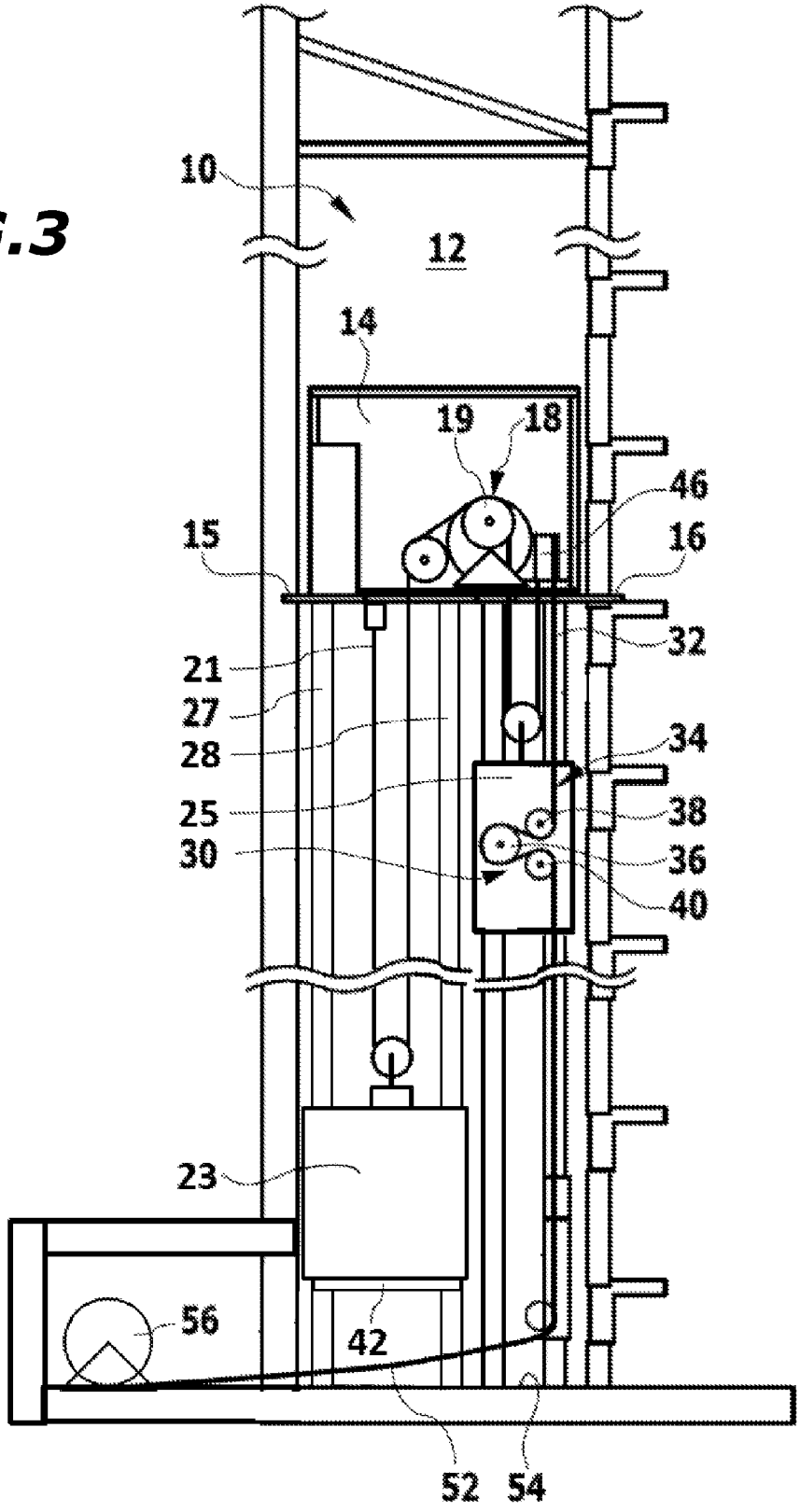
FIG. 3 is a schematic representation of another example elevator system similar to that shown in FIG. 1, except here an example speed limiter is disposed on the counterweight and a storage region is disposed outside the shaft.

The first cable section 32 is clamped between a cable retainer 46 that is arranged in a temporary machine compartment 14 and a releasable clamping device 50 arranged in the lower region 48 of the shaft 12. A second cable section 52 connects to the first cable section 32 of the speed limiter cable 34 in the lower shaft region 48, the end portion of which second cable section is wound, in the embodiment shown, onto a cable drum 56 that is mounted rotatably on the floor 54 of the shaft 12. The lower shaft region 48 thus forms a storage region for the second cable section 52. Alternatively, as illustrated in FIG. 3, for instance, the second cable section could also be stored outside the shaft 12, for example in an adjacent space.

Figure 2:
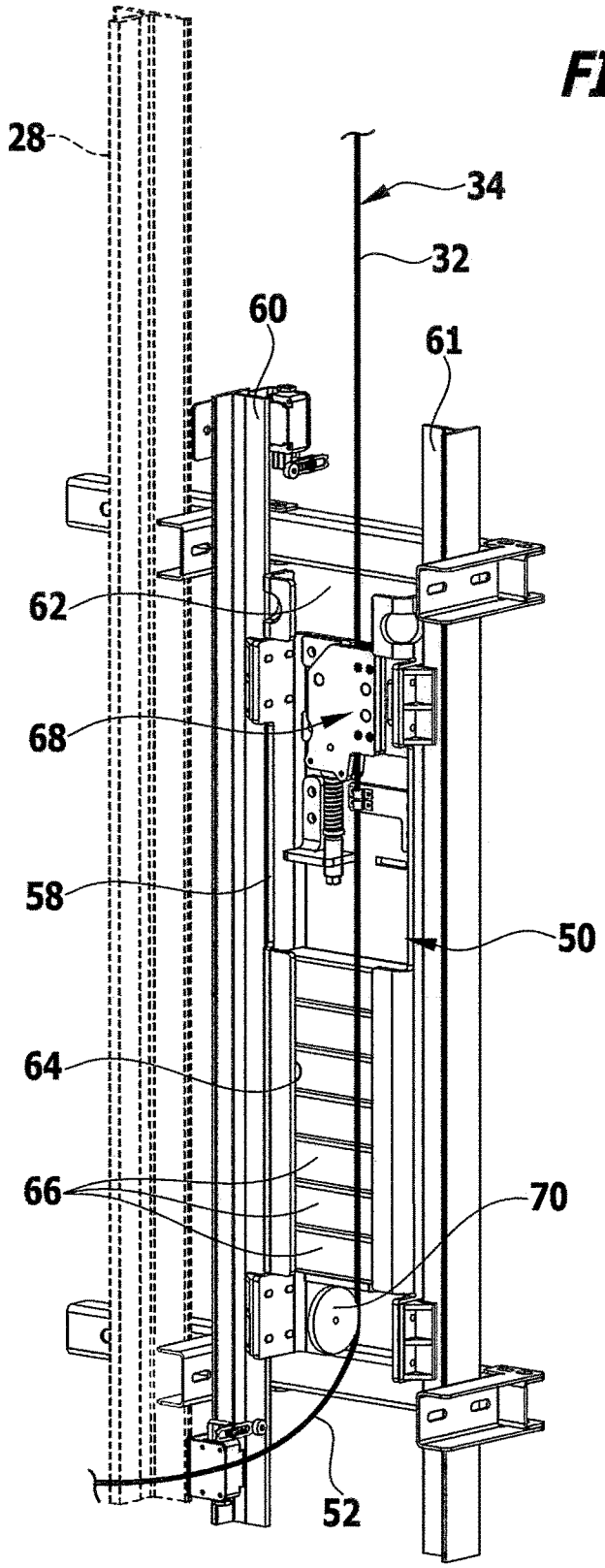
FIG. 2 is a perspective representation of a releasable clamping device arranged in a lower region of the shaft, for a speed limiter cable for the elevator system of FIG. 1.

As is evident in FIG. 2, the releasable clamping device 50 comprises a carriage 58 which is positioned between two second guiding rails 60, 61 and is held on these so as to be displaceable in the vertical direction. For the purpose of improved clarity, a first guiding rail 28 arranged laterally next to the second guiding rails 60, 61 is shown in a dashed line in FIG. 2.

The carriage 58 has a retaining section 62 which is oriented away from the shaft floor 54 and a recess section 64 which is oriented toward the shaft floor 54. Multiple weight elements 66 are held in the recess section 64 and can be inserted into the recess section 64 without the use of tools. A cable clamp 68, which is rigidly connected to the carriage 58, is held on the retaining section 62. The cable clamp 68 has two clamping jaws (not shown in the drawing) which can be moved back and forth between a clamping position and a release position. In the clamping position, they clamp the speed limiter cable 34 between them and in their release position they release the speed limiter cable 34.

When the elevator system 10 is in operation, the speed limiter cable 34 is clamped between the clamping jaws of the cable clamp 68 and the weight elements 66 apply a vertically downward-oriented clamping force on the first cable section 32. No clamping force acts on the second cable section 52, which adjoins the first cable section 32 in the lower shaft region 48, in contrast to the first cable section 32. The second cable section extends loosely from the cable clamp 68, via a deflection pulley 70 arranged at the lower end of the carriage 58, to the cable drum 56 arranged on the shaft floor 54, onto which drum the end portion of the second cable section 52 is wound. This end portion forms a cable store for the speed limiter cable 34.

As already mentioned, the elevator system 10 can be installed in the shaft of a building under construction. As construction progresses, the elevator system 10 can be moved stepwise vertically upward in the shaft 12. To that end, the machine compartment 14 can be raised once the attachment members 15, 16 have been moved from their retaining position (shown in FIG. 1) into a release position (not shown in the drawing). Once the machine compartment 14 has been raised, it can again be temporarily secured in the shaft 12 by means of the attachment members 15, 16. When moving the machine compartment 14, the cable clamp 68 is released such that a lengthening section of the speed limiter cable 34 can be unwound from the cable drum 56. Once the desired height for the machine compartment 14 has been reached, the speed limiter cable 34 can again be securely clamped by means of the cable clamp 68. Normal operation of the elevator system 10 can then resume.

Lengthening the speed limiter cable 34 when moving the temporary machine compartment 12 thus proves very simple. A cable store of the speed limiter cable 14 is kept ready in a storage region by means of the cable drum 56 and a desired lengthening section can be supplied simply to the effective length of the speed limiter cable 34, i.e. to the first cable section 32 extending between the cable retainer 56 and the cable clamp 68.

What is claimed is:

1. An elevator system for a building under construction, the elevator system comprising:
   - a temporary machine compartment disposed in a vertical shaft of the building under construction;
   - a drive device that is disposed in the temporary machine compartment and is coupled via a supporting cable to a car that can be made to move upward and downward in the vertical shaft; and
   - a speed limiter for limiting a speed of the car, wherein the speed limiter cooperates with a speed limiter cable disposed in the vertical shaft, wherein the speed limiter is disposed on the car or on a counterweight connected to the car via the supporting cable, wherein the speed limiter cable has a first cable section and a second cable section, wherein the first cable section is clamped in a positionally-fixed manner between a cable retainer that is connected in a positionally-fixed manner to the temporary machine compartment and a releasable clamping device disposed in a lower shaft region, wherein the second cable section is connected to the first cable section at the releasable clamping device in the lower shaft region and is stored in a storage region.

2. The elevator system as claimed in claim 1, wherein the storage region is disposed in the vertical shaft.

3. The elevator system as claimed in claim 1 wherein an end region of the second cable section is wound onto a cable drum in the storage region.

4. The elevator system as claimed in claim 3 wherein the vertical shaft has a pit and the cable drum is rotatably mounted in the pit.

5. The elevator system as claimed in one of the preceding claims wherein the releasable clamping device has a releasable cable clamp.

6. The elevator system as claimed in claim 5, wherein the releasable cable clamp cooperates with a clamping weight that can be made to move in the vertical direction.

7. The elevator system as claimed in claim 6 wherein the clamping weight has a carriage that is held on a guiding device such that the carriage can be displaced in the vertical direction, on which at least one weight element is held, and which is connected to the releasable cable clamp.

8. The elevator system as claimed in claim 7 wherein the guiding device has two guiding rails.

9. The elevator system as claimed in one of claims 1-4 wherein the car is guided on guiding rails.

10. The elevator system as in one of claims 1-4 wherein the storage region is disposed in the lower shaft region.

11. The elevator system as in one of claim 1, 3, or 4 wherein the storage region is disposed outside the vertical shaft.

12. An elevator system for a building under construction, the elevator system comprising:
   - a temporary machine compartment disposed in a shaft of the building under construction;
   - a drive device that is disposed in the temporary machine compartment and is coupled via a supporting cable to a car that moves within the shaft; and
   - a speed limiter for limiting a speed of the car, wherein the speed limiter cooperates with a speed limiter cable that is disposed in the shaft and has a first cable section and a second cable section, the first cable section being clamped between a cable retainer that is connected to the temporary machine compartment and a releasable clamping device, the second cable section being connected to the first cable section at the releasable clamping device, which is disposed in a lower shaft region beneath the car.

13. The elevator system of claim 12 wherein an end region of the second cable section is wound onto a cable drum disposed in a storage region disposed outside the shaft.

14. The elevator system of claim 12 wherein the shaft includes a pit, wherein an end region of the second cable section is wound onto a cable drum disposed in the pit.

15. The elevator system of claim 12 wherein the releasable clamping device comprises a releasable cable clamp that cooperates with a clamping weight configured to move vertically.

16. The elevator system of claim 15 wherein at least the first cable section of the speed limiter cable is put in tension by the clamping weight.

17. The elevator system of claim 16 wherein the clamping weight comprises a carriage that is held on a guiding device that permits the carriage to move vertically.

18. The elevator system of one of claims 12-17 wherein the speed limiter is disposed on the car or on a counterweight connected to the car.

19. The elevator system of one of claims 12-17 wherein the first cable section is clamped in a positionally-fixed manner between the cable retainer and the releasable clamping device.

* * * * *